US007323069B2

(12) United States Patent
DasGupta et al.

(10) Patent No.: US 7,323,069 B2
(45) Date of Patent: Jan. 29, 2008

(54) SQUEEZE AND SEMI-SOLID METAL (SSM) CASTING OF ALUMINUM-COPPER (206) ALLOY

(75) Inventors: Rathindra DasGupta, Portage, MI (US); Zach Brown, Kalamazoo, MI (US); Mark Musser, Osceola, IN (US)

(73) Assignees: Contech U.S., LLC, Wilmington, DE (US); Contech Operating UK, Ltd, Welshpool, Powys (GB)

( * ) Notice: Subject to any disclaimer, the term of this patent is extended or adjusted under 35 U.S.C. 154(b) by 0 days.

(21) Appl. No.: 11/079,106

(22) Filed: Mar. 15, 2005

(65) Prior Publication Data

US 2005/0199364 A1 Sep. 15, 2005

Related U.S. Application Data

(60) Provisional application No. 60/552,707, filed on Mar. 15, 2004.

(51) Int. Cl.
*C22C 21/12* (2006.01)

(52) U.S. Cl. ..... 148/417; 420/535; 420/553

(58) Field of Classification Search ..... 420/528, 420/529, 535, 553; 148/417
See application file for complete search history.

(56) References Cited

U.S. PATENT DOCUMENTS

| | | | | |
|---|---|---|---|---|
| 4,007,771 | A * | 2/1977 | Welsch | 75/404 |
| 4,294,625 | A * | 10/1981 | Hyatt et al. | 148/550 |
| 5,431,876 | A * | 7/1995 | Kumar et al. | 420/529 |
| 5,503,690 | A * | 4/1996 | Wade et al. | 148/550 |
| 6,074,501 | A * | 6/2000 | Baxter et al. | 148/700 |
| 6,312,534 | B1 * | 11/2001 | Grensing | 148/437 |
| 6,368,427 | B1 * | 4/2002 | Sigworth | 148/439 |
| 6,612,593 | B2 * | 9/2003 | Mikasa et al. | 280/86.758 |
| 6,908,590 | B2 * | 6/2005 | DasGupta | 420/534 |

OTHER PUBLICATIONS

"ASM Handbook vol. 15 Casting", ASM International, 1988, pp. 323-326, 333.*

* cited by examiner

*Primary Examiner*—Roy King
*Assistant Examiner*—Janelle Morillo
(74) *Attorney, Agent, or Firm*—Baker & Hostetler LLP

(57) ABSTRACT

To cast a part, an injectable form of an aluminum-copper (206) alloy is generated and the aluminum-copper (206) alloy is injected into a mold. This mold corresponds to the part. In addition, the aluminum-copper (206) alloy is solidified to generate the part and the part is ejected from the mold.

15 Claims, 4 Drawing Sheets

Effect of Process Parameters on Centerline Shrink Occurrence in H-Blocks

SQUEEZE AND SEMI-SOLID METAL (SSM) CASTING OF ALUMINUM-COPPER (206) ALLOY

CROSS REFERENCE TO RELATED APPLICATIONS

This application claims priority to U.S. Provisional Patent Application Ser. No. 60/552,707, filed on Mar. 15, 2004, titled "SQUEEZE AND SEMI-SOLID METAL (SSM) CASTING OF ALUMINUM-COPPER (206) ALLOY," the disclosure of which is incorporated herein by reference in its entirety.

FIELD OF THE INVENTION

The present invention relates generally to metal casting. More particularly, the present invention relates to a system and method of semi-solid metal casting of aluminum-copper (206) alloy.

BACKGROUND OF THE INVENTION

Regular casting methods such as conventional die casting, gravity permanent mold casting, and squeeze casting have long been used for metals and their alloys. However, these current processes when used to manufacture parts with relatively complex geometries often yield products with undesirable shrink porosity, which can adversely impact the quality and integrity of the part. Shrink porosity defines a condition that arises as a metal part begins to shrink as it cools and solidifies along the outer surface, leaving "voids" trapped in the center of the part. If the voids are not reconstituted with metal, the cast part is termed "porous." Particularly in the design of complex parts, such as, for example, automotive steering knuckles, the greatest shrink porosity is found in the thicker areas. Furthermore, this condition is especially prevalent in conjunction with the use of Aluminum alloys.

Accordingly, it is desirable to provide a method of casting metals and alloys utilizing conventional and/or rheocasting die casting devices that can impart desirable mechanical properties. It is further desirable to provide a process to control the shrink porosity of cast parts at multiple locations though out a part.

SUMMARY OF THE INVENTION

The foregoing needs are met, to a great extent, by the present invention, wherein in one aspect an apparatus is provided that in some embodiments provides a process to control the shrink porosity of cast parts at multiple locations through out a part.

An embodiment of the present invention relates to a method of casting a part. In the method, an injectable form of an aluminum-copper (206) alloy is generated and the aluminum-copper (206) alloy is injected into a mold. This mold corresponds to the part. In addition, the aluminum-copper (206) alloy is solidified to generate the part and the part is ejected from the mold.

Another embodiment of the present invention pertains to method of casting a part. In the method, an injectable form of an aluminum-copper (206) alloy is generated and the aluminum-copper (206) alloy is injected into a mold at a gate velocity of about 10 inches per second to about 200 inches per second and a piston pressure of about 3000 pounds per square inch (psi) to about 14000 psi. This mold corresponds to the part. In addition, the aluminum-copper (206) alloy is solidified to generate the part and the part is ejected from the mold.

Yet another embodiment of the present invention relates to a cast product includes an injectable form of an aluminum-copper (206) alloy injected into a mold at a gate velocity of about 10 inches per second to about 200 inches per second and a piston pressure of about 3000 pounds per square inch (psi) to about 14000 psi, wherein the cast product is solidified in the mold and ejected from the mold.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

In an embodiment, vertical die casting machines or presses of the general type from THT Presses, Inc., Dayton, Ohio, are desirable. The THT presses such as a 200 Ton Indexing Shot Machine, a 1000 Ton Shuttle Machine or a 100 Ton Shuttle Machine, in particular, produce higher quality parts without porosity. The die casting presses are also simpler and less expensive in construction, requiring less maintenance and therefore more convenient to service.

One of ordinary skill in the art will appreciate from the descriptions herein, that some or all of the features of the presses suitable for use in embodiments of invention may differ to some extent from those specified below depending on the specific press, but that variations are to be expected and are within the scope and spirit of the present invention.

By way of example, the THT presses suitable for use in embodiments of the invention may be classified as "indexing-type" or "shuttle-type." Though the indexing press will be detailed in an embodiment below, both types of presses may be used in the instant invention. Also, as used herein, the term "about" has been incorporated in this disclosure to account for the inherent inaccuracies associated with measuring chemical weights and measurements known and present in the art.

Figure 1:
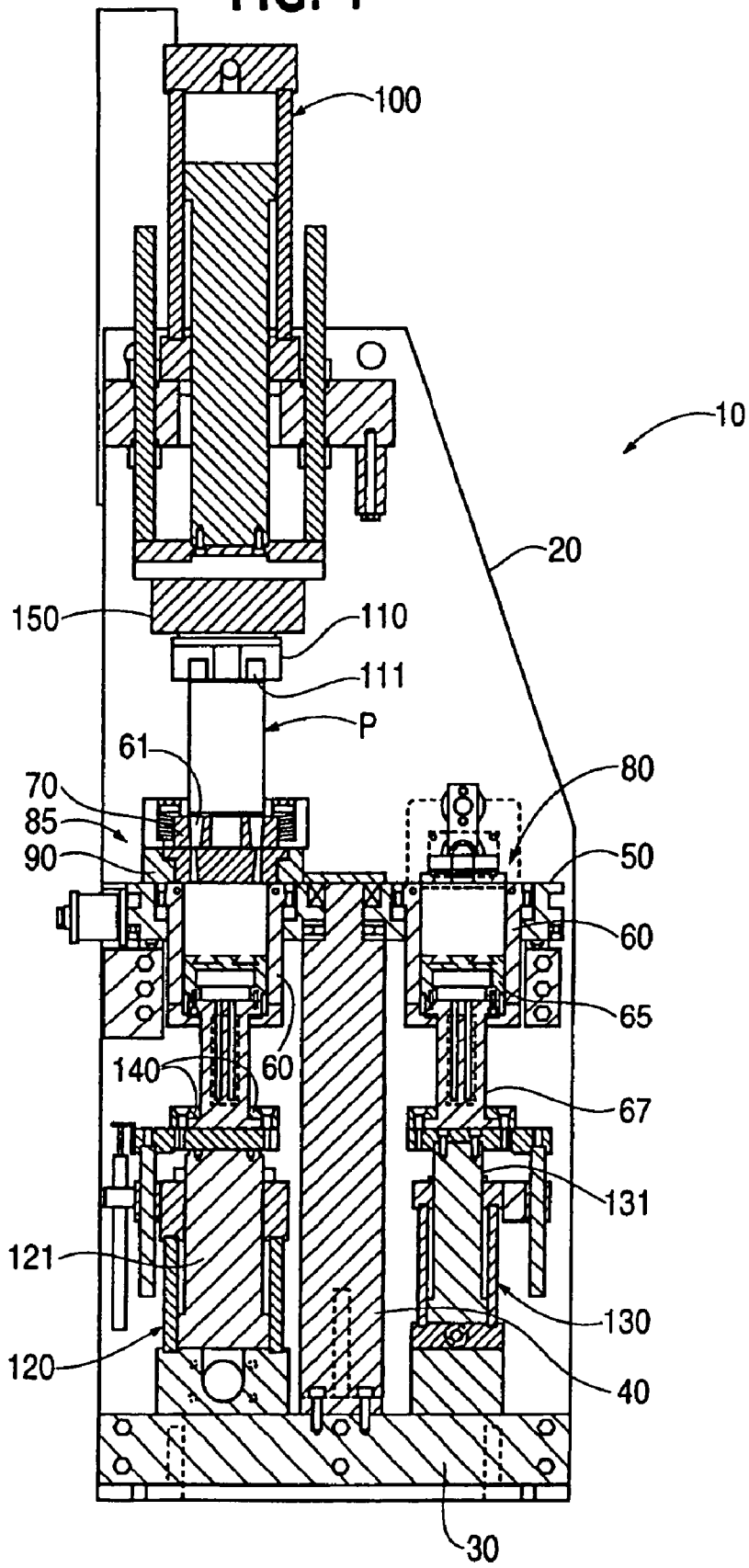
FIG. 1 illustrates a cross section of a vertical die casting press of a type suitable for carrying out the functions of an embodiment of the invention.
Figure 2:
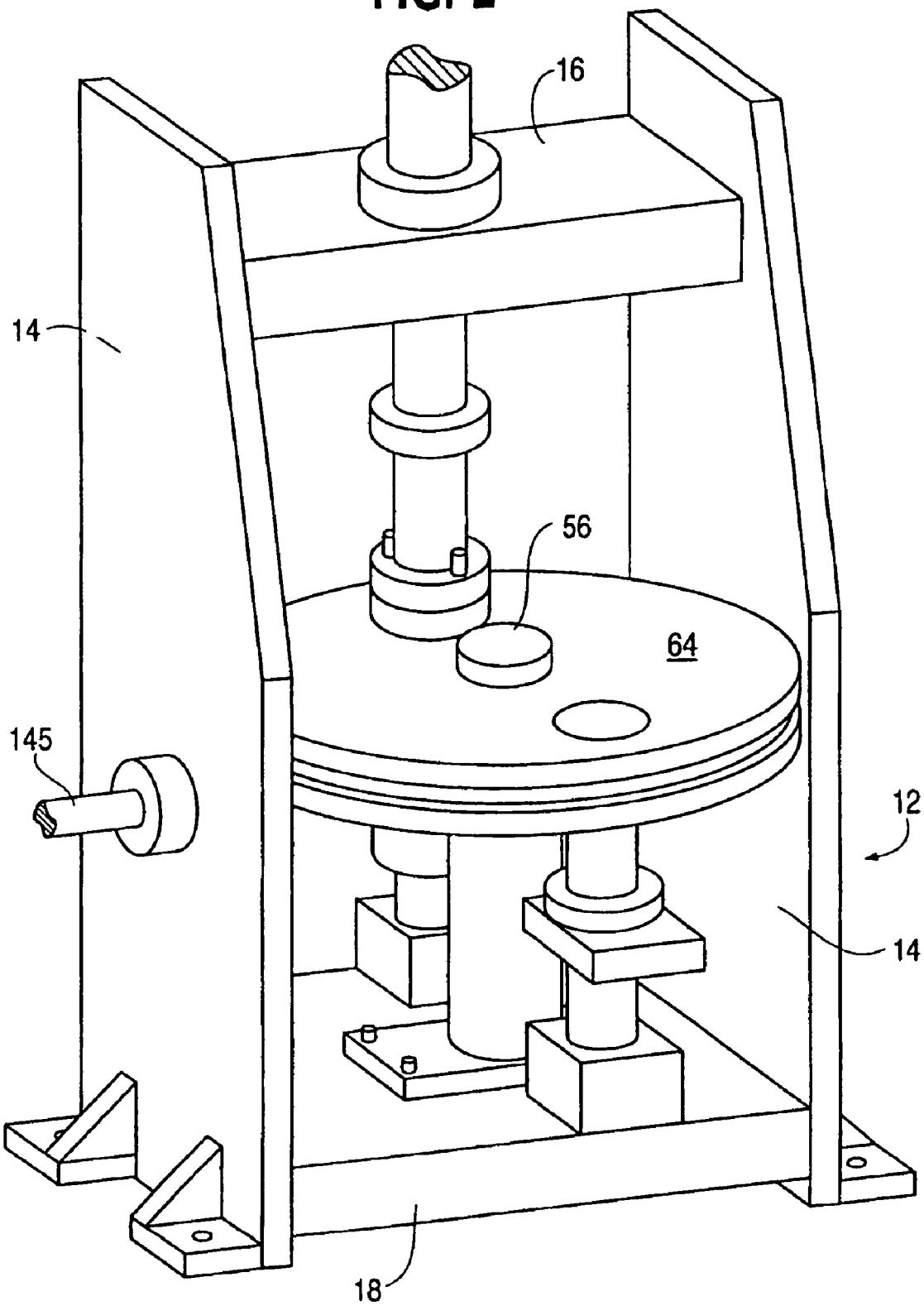
FIG. 2 is a perspective view of a vertical die casting press of a type suitable for carrying out the functions of an embodiment of the invention.

The invention will now be described with reference to the drawing figures, in which like reference numerals refer to like parts throughout. An embodiment in accordance with the present invention provides a method and apparatus for semi-solid casting of aluminum-copper (206) alloy. As shown in FIGS. 1 and 2, a vertical die casting press 10 includes a frame 20 having a base 30 supporting a vertical pedestal 40 or post on which is mounted a rotary indexing table 50. The table 50 supports a pair of diametrically opposite shot sleeves 60 each of which receives a shot piston 65 connected to a downwardly projecting piston rod 67. A gate plate 90 extends horizontally between the side walls of the frame 20 and above the indexing table 50 for supporting a lower mold 70 section defining a cavity 61. When the table 50 is indexed in steps of 180 degrees, the shot sleeves 60 are alternately located at a metal receiving or pour station 80 and a metal injecting or transfer station 85 under the gate plate 90. In operation, the shot sleeves 60 are alternately filled with aluminum-copper (206) alloy that is sufficiently hot so as to be in a liquid state and readily pourable. Thereafter, and prior to injecting the aluminum-copper (206) alloy up through the lower mold 70, the aluminum-copper (206) alloy is cooled or allowed to cool to a semi-solid state. A hydraulic clamping cylinder 100 is supported by the frame 20 above the transfer station 85 and moves an upper mold 110 section vertically above the lower mold 70 section.

A high pressure hydraulic shot cylinder 120 is mounted on the base under the transfer station 85, and a substantially smaller hydraulic ejection cylinder 130 is mounted on the base 30 under the metal receiving or pour station 80. Each of the hydraulic cylinders 120 and 130 has a non-rotating vertical piston rod 121 and 131 which carries a set of spaced coupling plates 140. Each set of plates 140 defines laterally extending and opposing undercut grooves for slidably receiving an outwardly projecting bottom flange on each of the shot piston rods. Thus when the rotary table 50 is indexed, the shot piston rods rotate with the shot sleeves 60 and alternately engage the piston rods of the two fixed hydraulic shot 120 and ejection cylinders 130.

The upper platen moves downwardly to close and clamp the upper mold 110 against the lower mold 70 or against a cavity defining part P confined between the upper and lower molds 110 and 70. It is to be understood that the present invention is not limited to the particular arrangement of the molds. In this regard, the use of at least horizontal die clamping and vertical, high pressure delivery systems are within the scope and spirit of the invention. To continue, the hydraulic shot cylinder 120 is actuated for transferring the semi-solid metal from each shot cylinder 60 upwardly into the cavity 61 defined by the clamped mold sections 70 and 110. The cavity 61 is evacuated, and the shot piston 65 is forced upwardly to inject the semi-solid metal into the mold cavity or cavities. The molds 70 and 110 and the shot piston 65 are then cooled, optionally by circulating water through passages within the molds and shot piston, to solidify the die cast material. The shot cylinder 120 then retracts the connected sprues 150 or biscuit downwardly into the shot sleeve 60 after the metal has partially solidified within the gate plate 90. After the table 50 is indexed 180 degrees, the smaller hydraulic ejection cylinder 130 is actuated for ejecting the biscuit upwardly to the top of the indexing table 50 where the biscuit is discharged. The cycle is then repeated for die casting another part or set of parts.

In the operation of the vertical die casting machine or press described above in connection with FIG. 1, a predetermined charge or shot of molten or semi-solid metal is poured into the shot sleeve 60 in the pour station 80. In general, semi-solid metal includes at least some portion of molten or liquidus metal and at least some portion of solid metal. The temperature of semi-solid metal is typically greater than the solidification temperature of the alloy and at or somewhat less than the liquidus temperature of the metal. To generate the semi-solid metal or maintain the temperature of the semi-solid metal, the shot sleeves 60 is optionally equipped with heaters and temperature sensors to heat and/or cool the metal as is desirable at any time, including the period while table 50 indexes 180 degrees. The lateral transfer of the molten or semi-solid metal and the upward injection of the molten or semi-solid metal into the mold cavities is also effective to degas the aluminum-copper (206) alloy, thereby minimizing porosity of the solidified die cast parts. Optionally, a light suction or partially vacuum is applied to the cavities 108 and runner 202 and the injecting chamber 146 to remove air from the chamber and to remove the gas separated from the molten metal within the shot cylinder.

The use of semi-solid metal or metal slurry metal as described herein over conventional molten metal reduces fluid turbulence when injected into the die. In this manner, the amount of air that is sequestered within the final part is reduced. Less air in the final part lends greater mechanical integrity and allows cast products to be heat treated. In addition, metals that are SSM cast require less heat thereby reduce the cost and improve the longevity of the molds and dies. In the following Table 1, typical, real-life values for mechanical properties of aluminum-copper (206) alloy when cast utilizing the indicated processes are provided:

TABLE 1

| Casting Method | Yield strength (Mpa) | Tensile strength (Mpa) | Elongation percent |
|---|---|---|---|
| Sand casting | 248 | 345 | 7 |
| Gravity permanent mold | 248-283 | 407-441 | 15-18 |
| Semi-solid metal | 248-269 | 400-421 | 23-26 |
| Squeeze casting | 248-269 | 400-421 | 21-26 |

As shown in Table 1, at least the elongation percent is greatly improved by SSM casting. That is, the toughness of the 206 alloy is greatly improved. When compared to sand cast 206 alloy, the increase in elongation percent to break is 3 to 4 times. This increase in toughness is unexpected when compared to other alloys that have only modest improvements in toughness. Also note that, at least, elongation percent of the 206 alloy is improved by squeeze casting. In the following Table 2, typical, real-life values for mechanical properties of aluminum-copper (206) alloy when SSM cast are compared to squeeze cast 356-T6 alloy:

TABLE 2

| Alloy | Yield strength (Mpa) | Tensile strength (Mpa) | Elongation percent | Fracture load (pounds) |
|---|---|---|---|---|
| 356-T6 | 220-241 | 297-317 | 10-14 | 7,113 |
| 206-T4 | 248-269 | 400-421 | 21-26 | 8,074 |

As shown, 206 alloy that is SSM cast demonstrates several advantages over other alloys. For example, a part made from squeeze casting 356 aluminum alloy offers lower strength and elongation than the same part made from SSM casting the 206 alloy as shown in Table 2. Thus, the overall toughness for the SSM cast 206 part is greater than that for squeeze cast 356 alloy. In a specific example, suspension links made from squeeze cast 356-T6 alloy were compared to the same suspension links made from SSM cast 206 alloy as shown in Table 2. As shown in Table 3, the average fracture load for the 206-T4 casting was 8,074 pounds whereas the fracture load for the 356-T6 component was 7,113 pounds. That is, the fracture load for the 356 alloy component was approximately 13% lower than that of 206 alloy component.

TABLE 3

| Alloy | Fracture load (pounds) |
|---|---|
| 356-T6 | 7,113 |
| 206-T4 | 8,074 |

Without being limited to or bound by theory, the microstructure of SSM cast products can determine the mechanical properties of the product. Moreover, it is understood by those of ordinary skill in the art that the microstructure can be manipulated prior to casting. One way to manipulate the final microstructure of an SSM cast part is to control, thereby reduce, the time the metal remains in the SSM range. The presses described above afford such an opportunity. Specifically, the indexing time (i.e., the delay between indexing between the pour station 80 and transfer station 85) can be used to control the time the molten metal is cooled in the shot sleeve to reach the SSM range. That is, the amount of time the metal spends in the shot sleeve before it is injected into the molds can be regulated or optimized for a desirable microstructure. Alternatively, molten metal at a predetermined temperature may be poured into the shot sleeve of shuttle presses, i.e. presses that lack the indexing feature.

Figure 3:
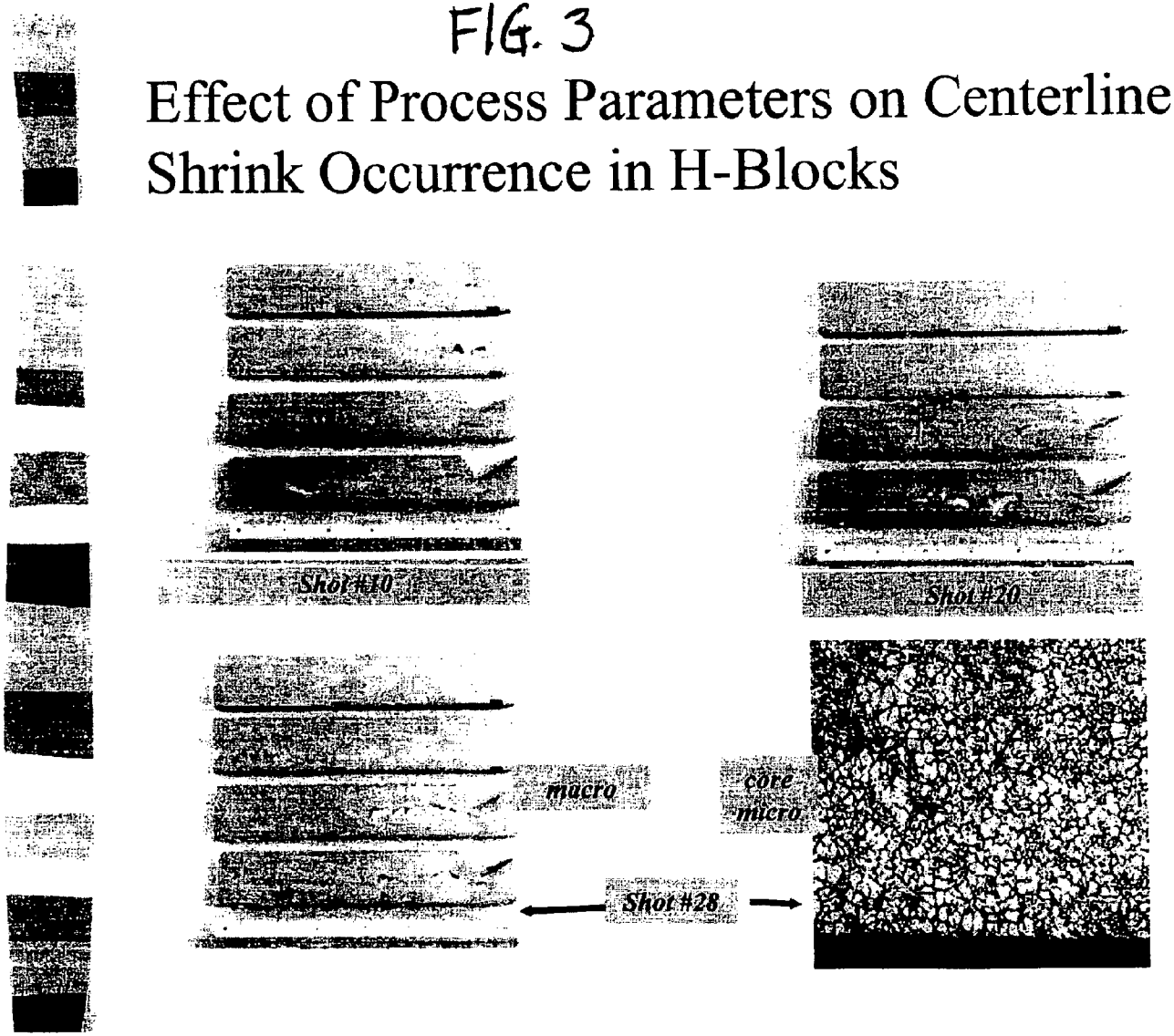
FIG. 3 illustrates cross sectional views of parts cast according to various embodiments of the invention.

In addition, the microstructure of parts cast utilizing the SSM method generally varies according to the amount of pressure placed upon the semi-solid metal during the casting process as well as the velocity of the plunger utilized to inject the semi-solid metal into the mold. FIG. 3 illustrates cross sectional views of three parts cast according to various embodiments of the invention. The parameters utilized to cast these respective parts is described in the following Table 4, in which, the amount of porosity in a SSM cast part as the pressure and plunger velocities are modified:

TABLE 4

| Sample number | Metal pressure (psi) | Gate velocity (inches/sec) | Porosity |
|---|---|---|---|
| 10 | 8421 | 19 | Yes |
| 20 | 8421 | 57 | Reduced |
| 28 | 5512 | 57 | None |

As shown in Table 4, by controlling the gate velocity to advance at 57 inches per second, the porosity is improved relative to a gate velocity of 19 inch per second. Additionally, by controlling the plunger to exert a pressure of 5512 psi, the porosity is improved relative to a pressure of 8421 psi. Gate dimensions are suitably modulated in accordance with the volume of the shot volume, the design of the part, and the like.

Figure 4:
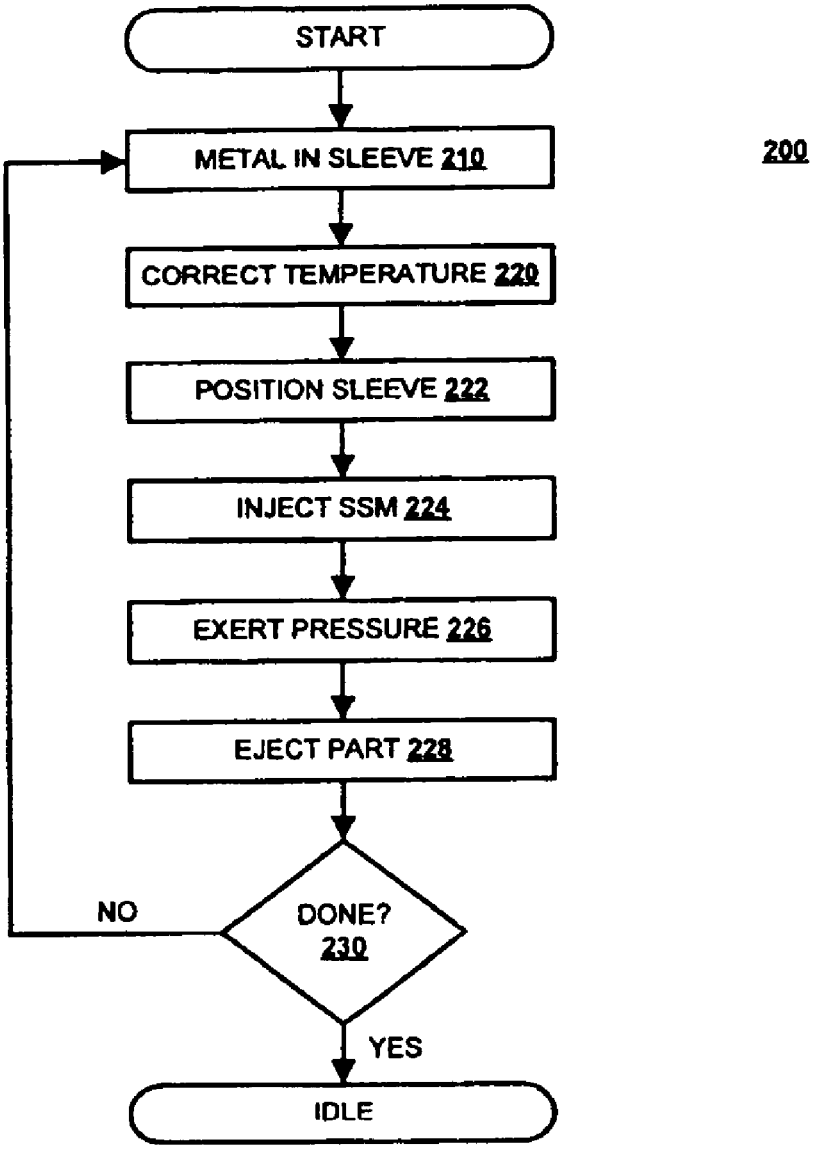
FIG. 4 is a flow diagram of a method of generating a cast part according to an embodiment of the invention.

FIG. 4 illustrates steps involved in a method 200 of casting a part according to an embodiment of the invention. It is an advantage that automotive control and suspension components generated according to embodiments of the invention show improved metallurgical properties when compared to other alloys and/or other casting methods. In particular, front and rear steering knuckles, front and rear control arms, suspension links, and the like benefit from fabrication according to embodiments of the invention. More generally, any suitable component that is improved by conversion from ductile (nodular) iron to an aluminum casting would also benefit from SSM casting 206 alloy according to embodiments of the invention. That is, because of the higher strength of the 206 alloy, a smaller section size (i.e., wall thickness) is feasible, as compared to 356 and/or other such alloys. The overall result is a 206 alloy part will weigh less than a 356 alloy part of comparable strength. Thus, embodiments of the invention enjoy a space and/or weight savings when compared to conventional casting of 356 alloys and the like. Additionally, the use of SSM casting offers a much higher overall integrity (i.e., reduced or essentially no porosity and the substantial elimination of "hot tears") than any other conventional casting process. These results are unexpected in light of the relatively low integrity and relatively high porosity of the 206 alloy when cast using sand casting, gravity permanent molding, or other such casting techniques. Moreover, squeeze casting the 206 alloy in accordance with embodiments of the invention includes some or all of the benefits of SSM casting.

In general, convention techniques of aluminum casting (e.g., gravity permanent mold casting, etc.) require the in-situ addition of grain refiners to achieve appropriate grain structure of cast products. These grain refiners initiate nucleation sites for metal crystals, however, use of grain refiners has certain disadvantages such as added cost and the like. It is a further unexpected benefit of embodiments of the invention that grain-refiners are not required to essentially eliminate hot tears when SSM cast the 206 alloy. As shown in FIG. 4, the method 200 is initiated at step 210 in response to liquid or semi-solid aluminum-copper (206) alloy being deposited in a shot sleeve 60.

At step 220, the aluminum-copper (206) alloy is brought to or allowed to achieve the appropriate temperature. That is, generally, the aluminum-copper (206) alloy is brought to an injectable temperature. For example, the aluminum-copper (206) alloy is brought to a liquidus temperature. In another example, the aluminum-copper (206) alloy is brought to a semi-solid temperature. In order to achieve the semi-solid temperature, the aluminum-copper (206) alloy is heated until liquidus and then cooled to until semi-solid, or a volume of liquidus aluminum-copper (206) alloy is mixed with an appropriate volume of relatively cooler aluminum-copper (206) alloy to form the semi-solid aluminum-copper (206) alloy.

At step 222, the shot-sleeve 60 and the lower mold 70 are disposed in proper alignment with respect to one another.

At step 224, the aluminum-copper (206) alloy is injected into the mold. For example, the hydraulic shot cylinder 120 is controlled to transfer the aluminum-copper (206) alloy in an upward manner and into the cavity 61. In a particular example, the hydraulic shot cylinder 120 is controlled to move at about 3 inches per second during the transfer with a pressure of 5512 psi. In other instances, the speed and/or pressure are modulated to account for variations in part dimensions and shot volumes. The speed of the shot cylinder 120 is directly proportional to the gate velocity or velocity of the semi-solid metal into the mold via the gate. The gate velocity is also inversely proportional to the cross sectional area of the gate. The gate velocity is a relatively good indicator of turbulence and thus, it is the gate velocity that is typically controlled for. Depending upon empirically derived results from destructive and other testing procedures, the gate velocity is varied from about 10 inches per second to about 200 inches per second and the piston pressure varies from about 3000 psi to about 12000 psi. More particularly, the gate velocity is varied from about 35 to 75 inches per second and the piston pressure varies from about 3000 psi to about 8000 psi.

At step 226, pressure exerted by the hydraulic shot cylinder 120 is maintained upon the aluminum-copper (206) alloy while it is cooled or allowed to cool. For example, a pressure of about 3000 psi to about 8000 psi is exerted upon the aluminum-copper (206) alloy as it is cooled. More particularly, a pressure of about 5512 pounds per square inch is exerted upon the aluminum-copper (206) alloy as it is cooled.

At step 228, the solidified part is ejected from the mold. Following the step 228, it is determined whether another part is to be molded.

At step 230 it is determined if another part is to be molded. If another part is to be molded, the mold is readied for the next shot and aluminum-copper (206) alloy is placed with the same or a different shot sleeve at step 210. If it is determined that the casting process is to halt, the die casting press is allowed to idle.

The many features and advantages of the invention are apparent from the detailed specification, and thus, it is intended by the appended claims to cover all such features and advantages of the invention that fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A cast product comprising:

an injectable form of an aluminum-copper (206) alloy injected into a mold at a gate velocity of about 10 inches per second to about 200 inches per second and a piston pressure of about 3000 pounds per square inch (psi) to about 14000 psi, wherein the cast product is solidified in the mold and ejected from the mold and wherein the cast product is T4 tempered following casting and wherein the cast product exhibits a yield strength of about 269 mega Pascals (Mpa), a tensile strength of about 421 Mpa, and an elongation percent of about 26.

2. The cast product according to claim 1, wherein the aluminum-copper (206) alloy is injected in the mold at a gate velocity of 57 inches per second.

3. The cast product according to claim 1, wherein the aluminum-copper (206) alloy is injected in the mold at a piston pressure of about 5512 psi.

4. The cast product according to claim 1, wherein the injectable form of the aluminum-copper (206) alloy is a liquidus form.

5. The cast product according to claim 1, wherein the injectable form of the aluminum-copper (206) alloy is a semi-solid form.

6. The cast product according to claim 1, wherein the cast product is suspension component.

7. The cast product according to claim 6, wherein the cast product includes at least one of a front steering knuckle, rear steering knuckle, front control arm, and rear control arm.

8. The cast product according to claim 1, wherein the cast product is an automotive component.

9. The cast product according to claim 1, wherein the cast product does not include an in-situ addition of a grain refiner.

10. A suspension component for a vehicle comprising:

an aluminum-copper (206) alloy injected into a mold in a semi-solid form at a gate velocity of about 10 inches per second to about 200 inches per second and a piston pressure of about 3000 pounds per square inch (psi) to about 14000 psi, wherein the suspension component is solidified in the mold and ejected from the mold and wherein the suspension component is T4 tempered following casting and wherein the suspension component exhibits a yield strength of about 269 mega Pascals (Mpa), a tensile strength of about 421 Mpa, and an elongation percent of about 26.

11. The suspension component according to claim 10, wherein the aluminum-copper (206) alloy is injected in the mold at a gate velocity of 57 inches per second.

12. The suspension component according to claim 10, wherein the aluminum-copper (206) alloy is injected in the mold at a piston pressure of about 5512 psi.

13. The suspension component according to claim 10, wherein the suspension component includes at least one of a front steering knuckle, rear steering knuckle, front control arm, and rear control arm.

14. The suspension component according to claim 10, wherein the suspension component is an automotive component.

15. The suspension component according to claim 10, wherein the suspension component does not include an in-situ addition of a grain refiner.

* * * * *